United States Patent [19]

Wiedemann

[11] 4,443,908

[45] Apr. 24, 1984

[54] SEWER CLEANING VEHICLE

[76] Inventor: Karl Wiedemann, Haldenloh 2 a, 8901 Welden, Fed. Rep. of Germany

[21] Appl. No.: 371,178

[22] Filed: Apr. 23, 1982

[51] Int. Cl.[3] ..... B08B 3/02; B08B 9/04

[52] U.S. Cl. ..... 15/302; 134/168 C; 210/294

[58] Field of Search ..... 15/302, 320; 134/169 C, 134/168 C; 210/104, 260, 197, 294, 512.2, 522

[56] References Cited

U.S. PATENT DOCUMENTS

| | | | |
|---|---|---|---|
| 4,132,645 | 1/1979 | Bottomley et al. | 210/104 |
| 4,134,174 | 1/1979 | Flynn et al. | 15/302 |
| 4,233,706 | 11/1980 | Kauffeldt | 15/353 X |
| 4,295,244 | 10/1981 | Herpers et al. | 15/320 |

*Primary Examiner*—Chris K. Moore

*Attorney, Agent, or Firm*—Collard, Roe & Galgano

[57] ABSTRACT

A sewer cleaning vehicle has a swilling or clean water tank for supplying a sewer cleaning hose having a sewer cleaning nozzle and designed to be lowered into a sewer to be cleaned, a waste tank and a pumping connection joining the waste tank with the swilling water tank. Furthermore, there is a water cleaning unit as part of a system for topping up the swilling water tank with water from the waste tank. For producing a high level of setling effect in the swilling water tank, this tank has generally upright separating walls for causing a division into a number of spaces placed hydraulically in series, the most upstream space being that joined up with the pumping connection. Each such space is joined up with the hydraulically next one by at least one let-through opening in the wall near the floor of the swilling water tank, the upstream side of each such opening being joined up with a flexible hose which, by way of a float is kept at the top of the water in the upstream one of the two spaces for skimming off cleaned water from the top of the space.

7 Claims, 3 Drawing Figures

SEWER CLEANING VEHICLE

BACKGROUND OF THE INVENTION

The present invention is with respect to a sewer cleaning vehicle with a swilling or clean water tank for supplying a sewer cleaning hose having a sewer cleaning nozzle and designed to be lowered into a sewer to be cleaned, and furthermore with a waste tank joined up with one end of an aspiration hose designed to be lowered into the sewer. There is furthermore a pumping connection joining the waste tank with the swilling water tank and a system, having a water cleaning unit, for topping up the swilling water tank with water from the waste tank.

The swilling water tank may be designed for functioning as a settling vessel for separation of any dirt still in the water, as part of the water cleaning unit. In known vehicles of this sort, the swilling or cleaning water tank is not walled off into spaces: Although there is a certain amount of settling out of dirt from the water, the settling effect is frequently not great enough because there is no full separating effect in the swilling water tank.

GENERAL OUTLINE OF THE INVENTION

In view of this, one purpose of the invention is making a simple further development of a sewer cleaning vehicle of the sort noted such that a high efficiency of settling is produced in the water in the system.

As part of the invention, this purpose may be effected in a surprisingly simple way if the swilling water tank is walled off by generally upright separating walls into a battery of spaces which are placed hydraulically in series with a first upstream head space getting water from the pumping connection so that the water makes its way from one space to the hydraulically next one by at least one let-through opening in the walls, each such let-through opening being placed near a floor of the space in question and being joined on its upstream side with a moving skimming pipe having a float at an open skimming end thereof.

Because of this design, it is possible to make certain that there is not only a settling motion of dirt within the water, but furthermore, as a useful effect, a separating effect inasfar as water is only moved from one space to the next one by skimming off water from the top of the upstream one of the two spaces, such water having been cleaned to a very high degree in a short settling time. The water then makes its way into the next space. Because this separating operation takes place more than once, it will be seen that the settling or clearing effect is greatly stepped up. Nevertheless, it is possible to make certain that all spaces in the swilling water tank are filled and emptied, generally speaking equally and at the same time so that water will, at all times, be on hand at the outlet pipe of the space which is hydraulically furthest downstream so that the cleaning vehicle is ready for use at all times.

The swilling water tank, walled off into spaces, may best take the form of a box-like piece of bodywork fixedly supported on the chassis of the vehicle and, as seen from the outside, seeming to be made in one piece and having a breadth generally equal to the breadth of the vehicle. In its top wall, the swilling tank may have an upwardly open pocket running along the middle of the vehicle symmetrically and having a cross-section matching the cross-section of the waste tank, which is designed so that it may be rocked about an axis near the back end of the vehicle. With such a design it is possible to have a large base area of the swilling water tank and, for this reason, a large overall settling area. At the same time, the design of the present invention makes certain that the distribution of the weight is at all times evenly balanced between the back and front axles of the vehicle, such weight distribution not being changed if the swilling water tank is completely full and the waste tank completely empty, or the other way round. Furthermore, because the swilling water tank is fixedly supported on the vehicle, there will be no undesired effects on settling therein when the waste tank is tipped upwards for emptying it.

A more specially simple, further development of the invention, which is to be preferred for this reason, is such that each of the skimming pipes is in the form of a moving length of hose, this making it possible to keep the inlet opening in line with the water level at any given time in a specially simple way.

As part of a further useful development of the invention, the space which is hydraulically furthest downstream and which has an outlet connection pipe, is made hydraulically small in comparison with the spaces upstream therefrom. This hydraulically last space is, for this reason used as a header for a pump joined therewith, such pump being able to take up water freely without causing a vacuum effect.

For many purposes, the settling effect produced in the swilling water tank in the present invention will be powerful enough. However, it is readily possible to have a further cleaning unit downstream from the swilling water tank if an even greater degree of cleaning of the water is needed. Such a unit may, however, be of small effective size because of the high-level settling effect in the swilling water tank. In fact, such further cleaning unit may make use of a cyclone which may be short-circuited as a further part of the invention.

LIST OF FIGURES AND DETAILED ACCOUNT OF WORKING EXAMPLES OF THE INVENTION

Further useful developments and details of the invention will be seen from the account now to be given of the invention as based on the figures, and in the claims.

Figure 1:
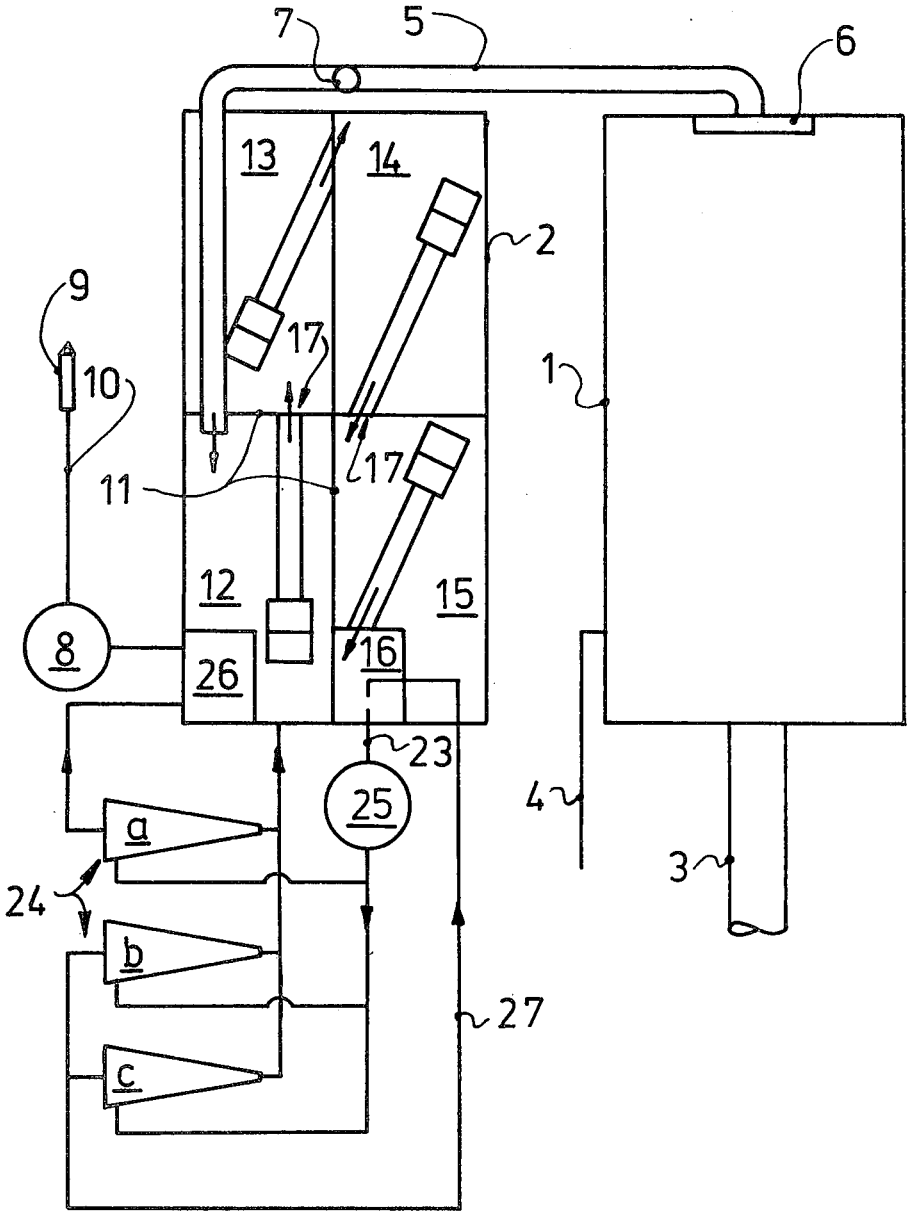
FIG. 1 is a block diagram of a first preferred working example of the invention.

The general structure and workings of a sewer cleaning vehicle are so well known that no detailed account is necessary at this point. Turning to FIG. 1 it is to be noted that a waste tank 1 is to be seen on the right while on the left there is a clean or swilling water tank 2, the two tanks being supported on a sewer cleaning vehicle which is not detailed in the figure. Aspiration hose 3, designed to be lowered down into a sewer to be cleaned, has its outlet end opening into the waste tank 1. The pressure pipe, joined up with a compressor and air pump (not figured) for putting the waste tank 1 under pressure and evacuating it is marked at 4. For topping up the swilling water tank 2 with water from the waste tank 1, there is a pump connection 5 joining the waste tank 1 with the swilling water tank 2, such connection 5 having at its inlet end at the waste tank a filter 6 for a first stage of cleaning the water taken from the waste tank 1. The pump connection 5 may be shut down using a slide valve or simply using a check valve 7 so that it is not possible for water to make its way back from the swilling water tank 2 to the waste tank 1. A high pressure pump 8 takes water from the swilling water tank 2 for operation of a cleaning hose 10 which has sewer cleaning nozzle 9 and may be lowered into the sewer in question.

Figure 2:
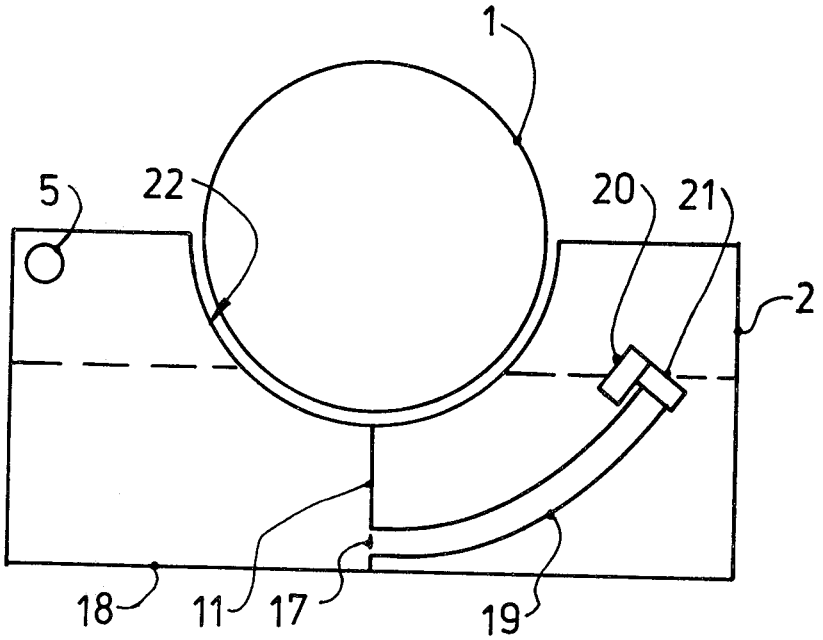
FIG. 2 is a view of a useful form of the swilling water tank and of the waste tank used therewith in a diagrammatic cross-section.

Inside it, the swilling water tank 2 is walled off into a battery of spaces by generally upright separating walls 11 stretching upwards from the floor of the swilling water tank 2, there being, in the present working example, five such spaces 12 to 16 (the last space 16 being much smaller than, and partly within space 15). Hydraulically downstream from the head or first space 12 there are the further spaces 13 to 16 so that there is an unbroken flow path from the head space 12 to the last space 16. Each space separating wall such as 11 has at least one let-through opening 17. Such let-through openings 17 are, as may be seen from FIG. 2, placed near the floor 18 of the swilling water tank 2 or its spaces. On the upstream side of each let-through opening 17 there is a skimming pipe 19 in the form of a moving length of hose, which, as well, may be seen in FIG. 2. Each skimming pipe 19 has a float 20 at its free end in the upstream space, such upstream end being open at 21.

The battery of spaces 12 in the swilling water tank 2, numbered 12 to 16, does in fact have the function of communicating vessels with the outcome that once water is run into the space 12, such water will make its way to the skimming pipes 5 and to all other spaces. The same is furthermore true for the opposite case of running off water from the last space 16. The moving skimming pipes 18, of which there is one for each let-through opening 17, and whose inlet openings 21 are kept at the level of the water by the float 20 next thereto, make certain that only clean water from the top of the body of water in each space is run off, which has been, generally speaking, quickly cleared of dirt by a settling effect, such water then making its way into the next space in the battery.

In FIG. 1 the waste tank 1 and the swilling water tank 2 are placed side-by-side horizontally. However, a useful effect is produced if the waste tank 1 is placed on top of the swilling water tank 2 on the lines to be seen in FIG. 2. The swilling water tank 2 may, in order to get a large settling area, best be fixedly supported on the vehicle's chassis (not detailed in FIG. 2) in the form of a box-like piece of bodywork which, as seen from the outside, seems to be made in one piece having a breadth generally equal to the breadth of the vehicle. In the present working example it will be seen that the top of the swilling water tank 2 has an upwardly opening hollow pocket 22 let into its middle part, in which the waste tank may be nested, the cross-section of the pocket matching the cross-section of the waste tank 1, which is so placed running along the middle of the vehicle symmetrically. This design has the useful effect of giving a symmetrical bodywork system and makes the best use of the space on hand while giving the largest possible settling area. A further useful effect is that there is an even distribution of weight between the axles of the vehicle.

Figure 3:
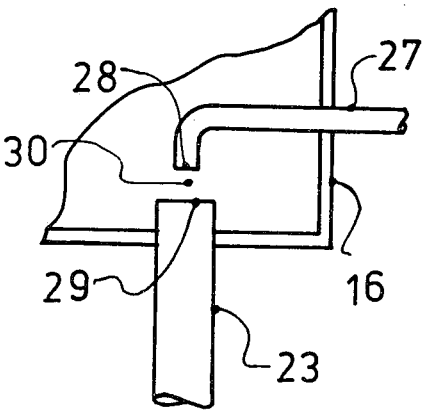
FIG. 3 is a view of part of the structure of FIG. 1.

The hydraulically last space 16 is, as may be seen from FIGS. 1 and 3, designed with an outlet connection pipe 23. In the present working example, the last space 16 is, generally speaking, only used as a header for a pump having its inlet connection joined up with the connection pipe 23, such pump being able to take up water freely without causing a vacuum effect. In comparison with the others, space 16 may be of a generally small hydraulic size, a settling effect in this space being generally unnecessary. The outlet connection pipe 23 may, for this reason, to good effect, be placed near the floor of the swilling water tank. If the settling and separating effect produced in the spaces 12 to 15 upstream from space 16 gives the desired cleaing effect, space 16 or its connection pipe 23 may be joined up directly with the high pressure pump 8.

In the present working example the settling unit, which, in the present case, is united with the swilling water tank, is joined up with the inlet of the last cleaning unit—generally numbered 24. For this purpose, use is made of a low pressure pump 25 joined up with the outlet connection pipe 23, for pumping the water into the last cleaning unit 24, from which the water makes its way to the high pressure pump 8 for the highest degree of cleaning. High pressure pump 8 takes in water by way of a header 26 (see FIG. 1), from which the water may be freely aspirated inasfar as no vacuum will be produced in the header even on the header's running dry. The last cleaning unit 24 is made up, in the present working example, of three cyclones **24*a*, 24*b* and 24*c* supplied from the low pressure pump 25 and whose lower outlets, for running off dirt, are joined up with the waste tank 1 or, as in the present working, with the first space 12, the top outlet of the first cyclone 24*a* opening into the header 26 on the inlet side of high pressure pump 8 and the top outlets of the further cyclones 24*b* and 24*c* being short-circuited, that is to say run back to the inlet, for stepping up the cleaning effect. In the present working example, the short-circuiting pipe 27 is run back directly to the space 16 on the inlet side of low pressure pump 25. A useful effect is produced if the short-circuiting pipe 27 comes to an end in such a way that its end cross-section 28 is placed opposite the inlet cross-section 29 of the outlet connection pipe 23 (see FIG. 3) with a small positive or negative distance therefrom, it having turned out that, on starting up plant of the present sort, the short-circuiting pipe 27 will firstly be full of air, such air being let off by way of the space 30 between the short-circuiting pipe 27 and the connection pipe 23 which is larger in size than it. At the same time, however, water may be aspirated through the space 30, with nothing stopping it, from space 16 for meeting the needs fully of the last cleaning unit 24 which is only partly short-circuited. Because of the placing of the cross-sections 28, 29** there is, in addition, a useful venturi effect.

I claim:

1. In a sewer cleaning vehicle with a swilling water tank fixedly supported on a chassis of said vehicle and having a breadth generally equal to the breadth of said vehicle, said swilling water tank having a top wall designed with an upward opening hollow pocket running along the middle of said vehicle, a sewer cleaning hose having a cleaning nozzle, joined with said tank and designed to be let down into a sewer for cleaning the same with water from said tank, with a waste tank nested in said pocket and matching said pocket cross-sectionwise, said waste tank being furthermore designed to be pivoted about an axis near a back end of said vehicle, with an aspiration hose opening at one end into said waste tank, with a pumping connection joining the waste tank with the swilling water tank and with a system having a water cleaing unit, said system being designed for topping up the swilling water tank with water from said waste tank, the invention residing in that said swilling water tank is walled off by generally upright separating walls into a battery of spaces hydraulically cascaded together in series starting at a first head space designed to take up material from said pumping connection, each said space in said battery being joined up with the hydraulically next one in the battery by a let-through opening in one of said separating walls, each said let-through opening having on an upstream side thereof a flexible hollow skimming pipe with a float at an open skimming end thereof furthest from said separating wall opening for keeping said skimming end generally at the top of water in said space.

2. The sewer cleaning vehicle as claimed in claim 1, wherein each said skimming pipe is made of a flexible material such as a hose.

3. The sewer cleaning vehicle as claimed in claim 1, wherein that space in the battery which is hydraulically furthest downstream has a smaller hydraulic size than the other spaces.

4. The sewer cleaning vehicle as claimed in claim 1, having an outlet connection pipe joined with said swilling water tank, a low pressure pump joined with said connection pipe, a last cleaning unit joined with said low pressure pump on an outlet side thereof, and a high pressure pump joined with said sewer cleaning hose.

5. The sewer cleaning vehicle as claimed in claim 4, having a header joined with an outlet end of said last cleaning unit and with an inlet connection of said high pressure pump.

6. The sewer cleaning vehicle as claimed in claim 5, wherein said header is placed bodily within, but hydraulically shut off from said swilling water tank.

7. The sewer cleaning vehicle as claimed in claim 1 having an outlet connection pipe joined with said swilling water tank, a low pressure pump joined with said connection pipe, a last cleaning unit joined with said low pressure pump on an outlet side thereof, and a high pressure pump joined with said sewer cleaning hose, said last cleaning unit having at least one cyclone and being partly short-circuited, said vehicle having a short-circuiting pipe for effecting said short-circuiting, said short-circuiting pipe being joined up with that space of said battery which is furthest downstream and being placed near the inlet cross-section of the outlet pipe connection joined with said furthest downstream space.

* * * * *